US008105664B2

(12) United States Patent
Tsai et al.

(10) Patent No.: US 8,105,664 B2
(45) Date of Patent: Jan. 31, 2012

(54) ARTIFICIAL DECORATIVE PLANT

(76) Inventors: Yuan Loung Tsai, Nantou (TW); Yuan Lei Tsai, Nantou (TW)

( * ) Notice: Subject to any disclaimer, the term of this patent is extended or adjusted under 35 U.S.C. 154(b) by 37 days.

(21) Appl. No.: 12/724,821

(22) Filed: Mar. 16, 2010

(65) Prior Publication Data

US 2011/0033641 A1 Feb. 10, 2011

(30) Foreign Application Priority Data

Aug. 6, 2009 (TW) ..... 98214510 U

(51) Int. Cl.
*A47G 33/06* (2006.01)

(52) U.S. Cl. ..... 428/18; 428/17; 428/20; 428/27

(58) Field of Classification Search ..... 428/17–20, 428/27; 362/123; 493/956; *A47G 33/06*
See application file for complete search history.

(56) References Cited

U.S. PATENT DOCUMENTS 3,101,291 A * 8/1963 Lalick ..... 428/7
3,131,112 A * 4/1964 Abramson ..... 428/8
4,496,615 A * 1/1985 Huang ..... 428/9
4,897,292 A * 1/1990 Glickman ..... 428/8
5,015,510 A * 5/1991 Smith ..... 428/18
6,099,920 A * 8/2000 Kao ..... 428/18
6,333,083 B1 * 12/2001 Smedley et al. ..... 428/8
7,232,596 B2 * 6/2007 Lai ..... 428/18
2002/0097573 A1 * 7/2002 Shen ..... 362/123
2003/0099786 A1 * 5/2003 Wang ..... 428/6
2005/0249892 A1 * 11/2005 Rocheleau ..... 428/18
2006/0246236 A1 * 11/2006 Lai ..... 428/18

* cited by examiner

*Primary Examiner* — Aaron Austin
(74) *Attorney, Agent, or Firm* — Alan Kamrath; Kamrath IP Lawfirm, PA

(57) ABSTRACT

An artificial decorative plant assembles multiple branches first which are then assembled with a main stem. Each branch is composed of a rod with resilience, a securing piece and multiple branch strips. The securing piece has two longitudinal sides and multiple clamping pieces alternatively staggered and extended from the two longitudinal sides respectively with multiple intervals and applied to wrap the rod. Additionally, multiple clamping attachments are extended from the two longitudinal sides inside the multiple intervals respectively so that each clamping attachment is between two adjacent clamping pieces to engage a corresponding branch strip with leaves. After completing assembly of the securing piece and the rod, the combination engages the main stem by a hook element on the rod. Because of such structure, it not only enhances the combinational strength but further improves efficiency of assembly convenience.

6 Claims, 5 Drawing Sheets

ARTIFICIAL DECORATIVE PLANT

CROSS REFERENCE TO RELATED APPLICATIONS

The present application claims foreign priority benefit under Title 35, United States Code §119 of Taiwanese Application No. 098214510 filed on Aug. 6, 2009.

BACKGROUND OF THE INVENTION

1. Field of the Invention

The present invention relates to an artificial decorative plant and, more particularly, to an artificial decorative plant that is convenient in assembly and strengthened in structure.

2. Description of Related Art

With the living quality improvement of modern people, their household environment correspondingly focuses on embellishment artistry, especially for occasion-fitting decorations which are indispensable. Christmas Day is the most popular festival that people are crazy about, and it has various activities and numerous decorations. Thus, a Christmas tree is one of the commonest decorations, because it not only creates a Christmas atmosphere but also embellishes the dull living environment. To make the Christmas tree to be located indoors, artificial Christmas trees have been sold on the market that can be assembled during Christmas days and that can be disassembled for storage after festivals. With reference to FIG. 1 showing a perspective view of a conventional artificial Christmas tree in accordance with the prior art, the conventional artificial Christmas tree has a main stem 10 and multiple branches 12 fixed together by winding yarns 14 thereon. The main stem 10 and the branches 12 are made of metallic material without resilience. Although this conventional artificial Christmas tree is convenient in storage, it has no flexibility in disassembly, because the branches have to be detached or bent one by one that is time-consuming. Thus, the conventional artificial Christmas tree is not rapid and convenient in the assembly and detachment. Moreover, it also needs many skilled workers to tie the branches 12 on the main stem 10 so that production of this conventional structure is time-consuming and inefficient.

SUMMARY OF THE INVENTION

A main objective of the present invention is to provide an artificial decorative plant that is time-saving in assembly.

To achieve the foregoing objective, the artificial decorative plant has multiple leaves assembled and then attached to a main stem, wherein each leaf comprises:

a rod with a hook extended to engage the main stem;

at least one securing piece, with each securing piece having two longitudinal sides and multiple clamping pieces respectively formed on the two longitudinal sides with multiple intervals to wrap the rod;

multiple clamping attachments are extended from the two longitudinal sides, with each clamping attachment being between adjacent two of the multiple clamping pieces; and at least one branch strip combined with a corresponding one of the multiple clamping attachments.

Another main objective of the present invention is that the main stem and the rod are made of metal material without resilience so that assembling efficiency is improved and storage is convenient.

Still another main objective of the present invention is that the leaves and the rod are made of resilient metal material so that both can be reformed to maintain a tree shape when reassembled after long-term storage.

Further benefits and advantages of the present invention will become apparent after a careful reading of the detailed description with appropriate reference to the accompanying drawings.

DETAILED DESCRIPTION OF THE PREFERRED EMBODIMENT

An artificial decorative plant in accordance with the present invention assembles multiple branches first which are then assembled with a main stem. Each branch is composed of a rod with resilience, a securing piece and multiple branch strips. The securing piece has two longitudinal sides, and multiple clamping pieces are alternatively staggered and extended from the two longitudinal sides respectively with multiple intervals and applied to wrap the rod. Additionally, multiple clamping attachments are extended from the two longitudinal sides inside the multiple intervals respectively, so that each clamping attachment is between two adjacent clamping pieces to engage a corresponding branch strip with leaves. After completing assembly of the securing piece and the rod, the assembly body engages the main stem by a hook on the rod. Because of such structure, it not only enhances the combinational strength but further improves efficiency of assembly convenience.

Figure 1:
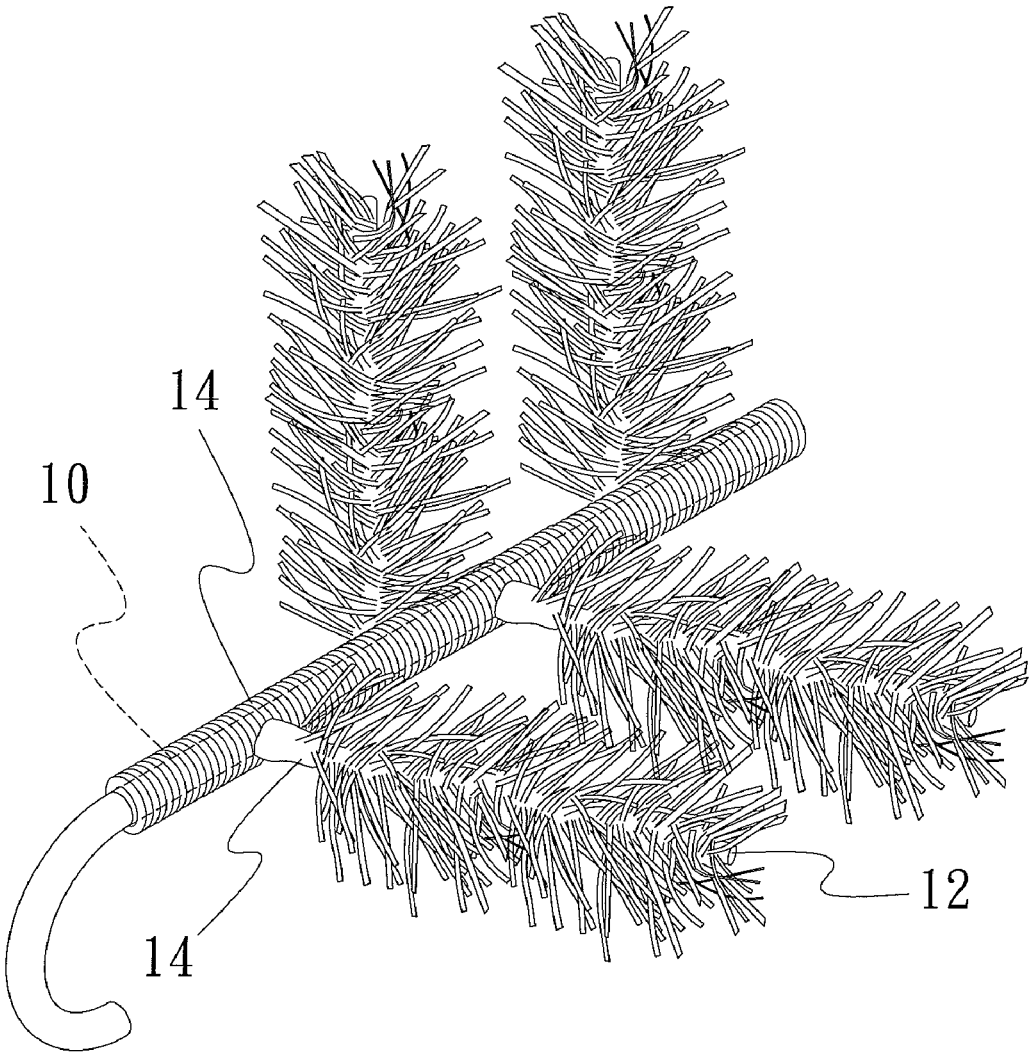
FIG. 1 PRIOR ART
FIG. 1 is a perspective view of a conventional artificial Christmas tree in accordance with the prior art.
Figure 2:
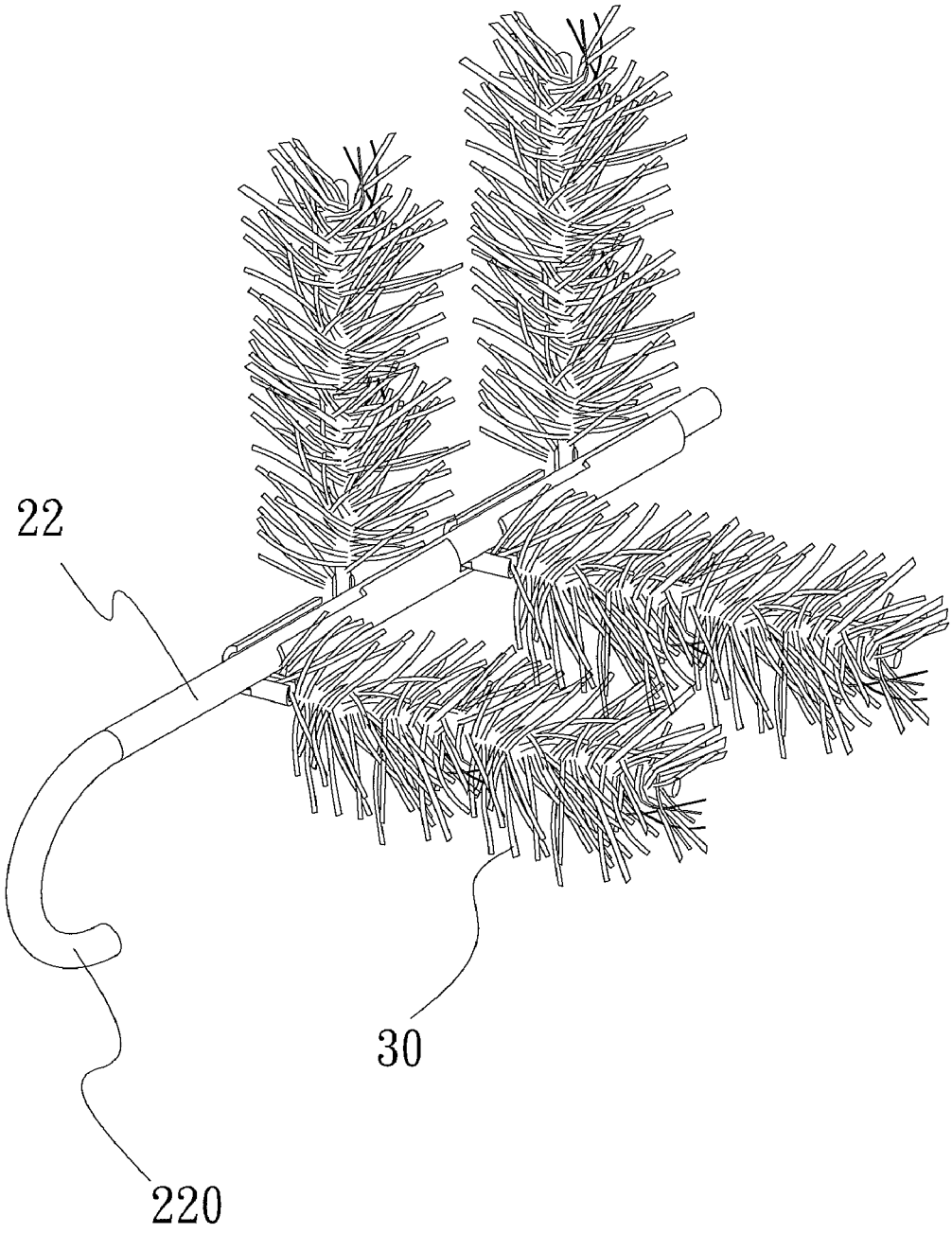
FIG. 2 is a perspective view of an artificial decorative plant in accordance with the present invention.
Figure 3:
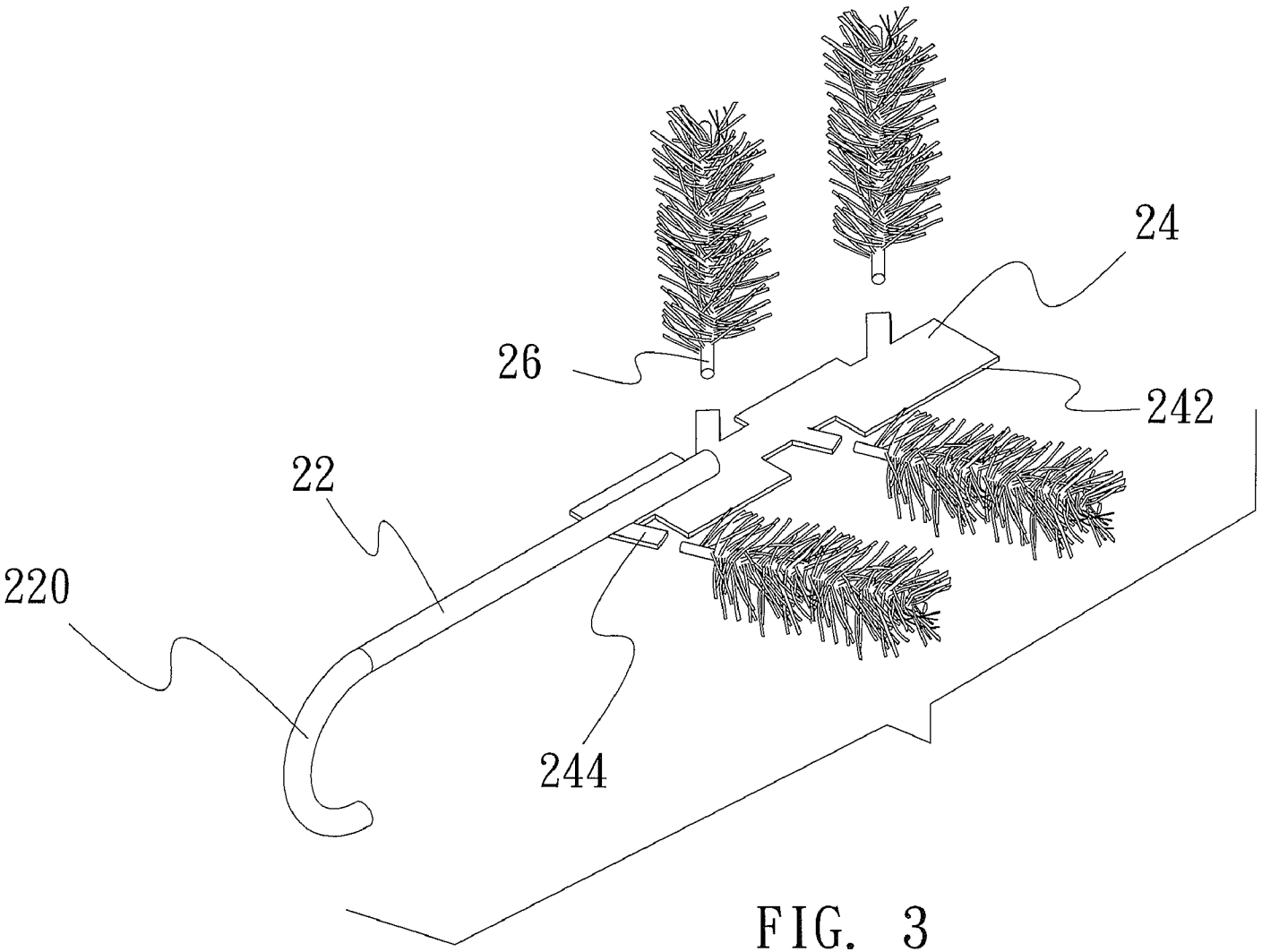
FIG. 3 is an exploded perspective view of the artificial decorative plant in FIG. 1.

As shown in FIGS. 2 and 3, a preferred embodiment of the artificial decorative plant in accordance with the present invention is shown. As clearly seen in the figures, multiple leaves 30 are assembled to be applied on a main stem (not shown). Each leaf 30 is composed of a rod 22, a securing piece 24 and multiple branch strips 26. The securing piece 24 has two longitudinal sides and multiple clamping pieces 242 alternatively formed on the two longitudinal sides respectively with multiple intervals. Additionally, multiple clamping attachments 244 are obliquely extended from the two longitudinal sides inside the multiple intervals respectively, so that each clamping attachment 244 is between two adjacent clamping pieces 242 inside a corresponding interval. All multiple clamping attachments 244 are oblique substantially in the same direction and from a sharp angle between itself and the securing piece 24. Thus, the branch strips 26 (metal wire material) with multiple leaves 30 (ex: PE or PVE) mounted on the clamping attachment 244 are enabled to spread. The above-mentioned rod 22 has a hook 220 extending from one distal end.

Figure 4:
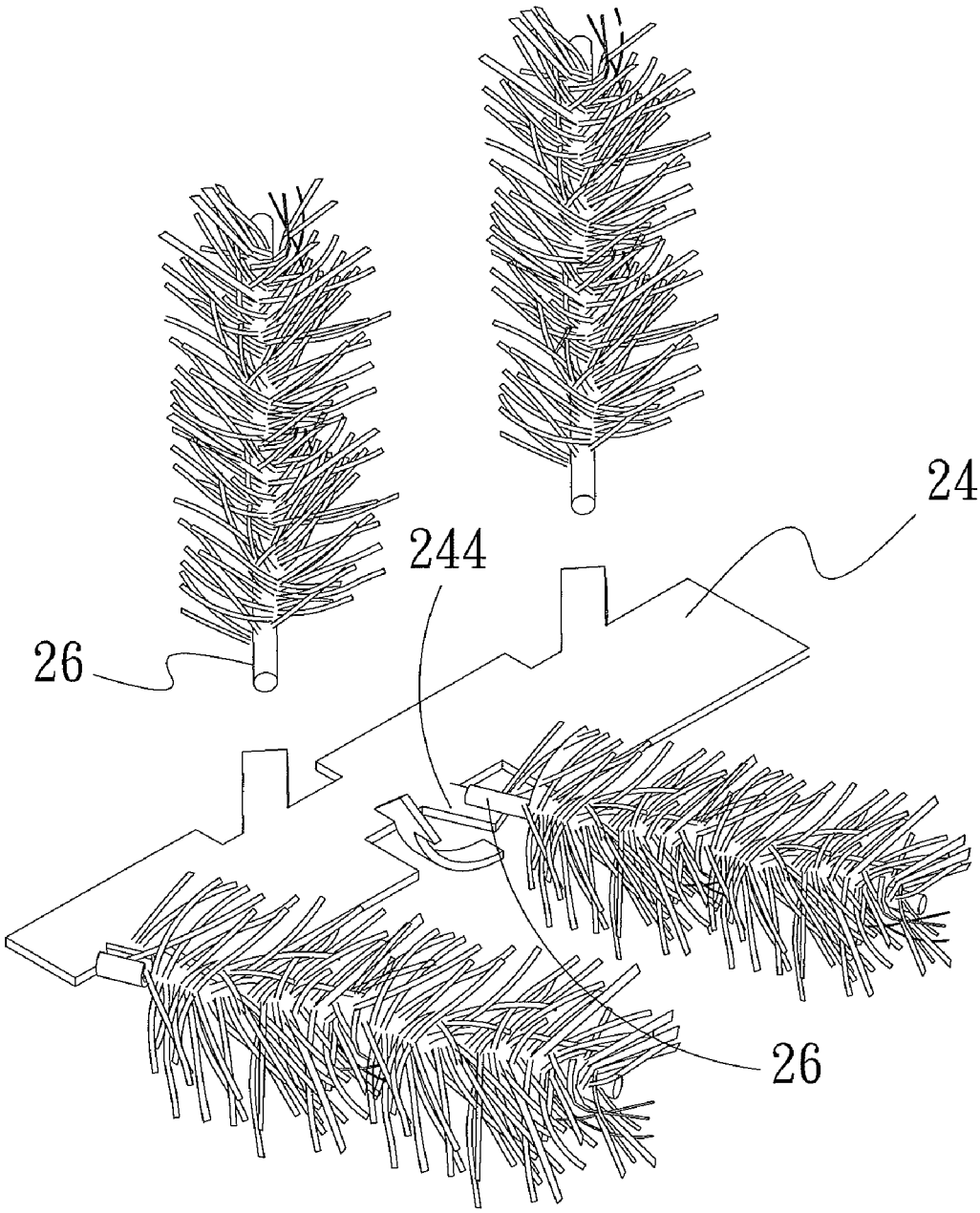
FIG. 4 is an operational perspective view (1) of the artificial decorative plant in the present invention.
Figure 5:
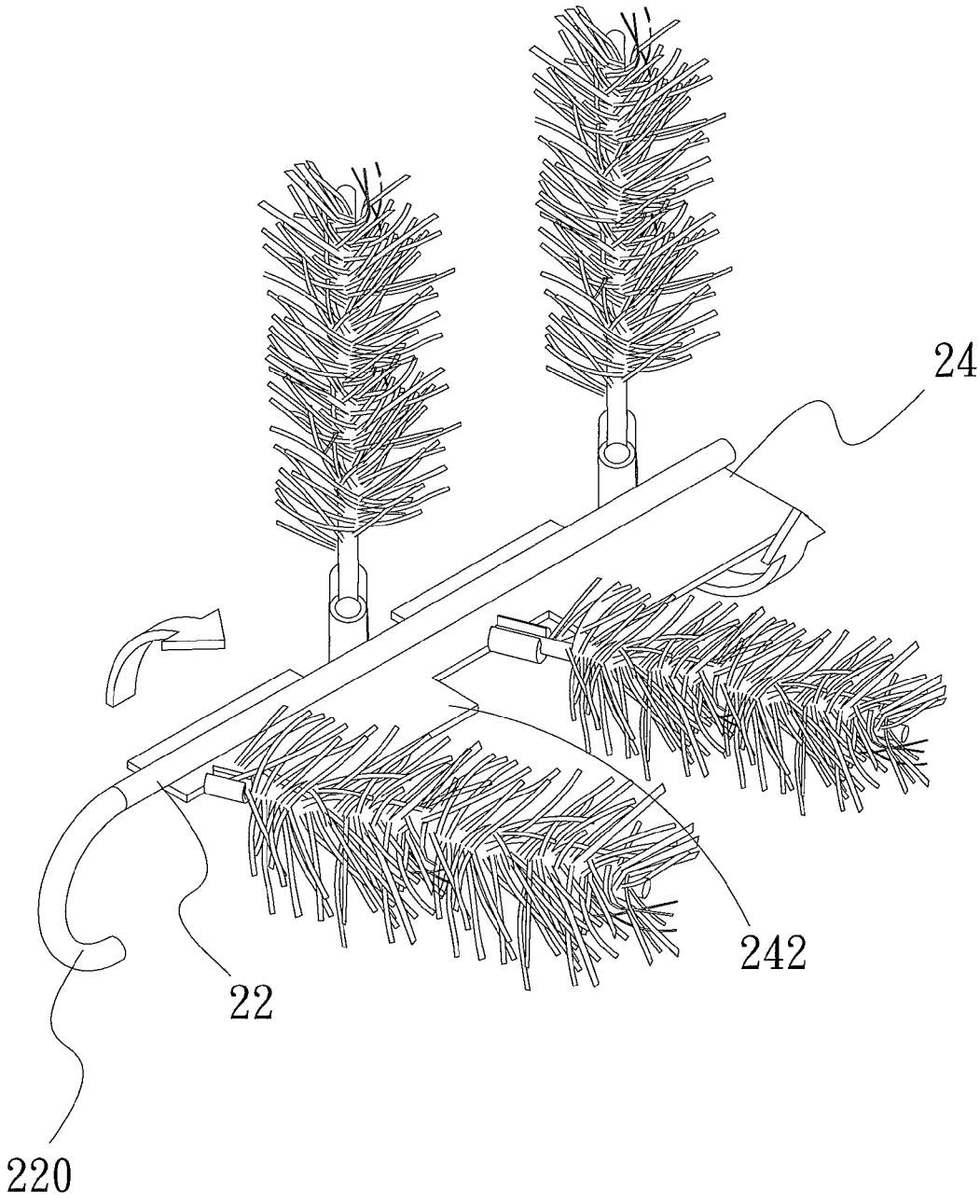
FIG. 5 is an operational perspective view (2) of the artificial decorative plant in the present invention.

By having above-described structure, operational steps of this invention are further illustrated below. As shown in FIGS. 4 and 5, the figures clearly show that the clamping pieces 242 alternatively staggered and extended from the two longitudinal sides of the securing piece 24 are bent to wrap and hold the rod 22. Additionally, the multiple clamping attachments 244 are extended between two adjacent clamping pieces 242 respectively, and the clamping pieces 242 are correspondingly bent and wrap the branch strips 26 each with multiple leaves 30. After completing assembly of the securing piece 24 and the rod 22, the assembly body engages the main stem by the hook 220 on the rod 22. Because of such structure, it not only enhances the combinational strength of the branch strip 26 and the rod 22 but further improves efficiency of assembly convenience Although this invention has been described in its preferred form with a certain degree of particularity, it is understood that the present invention of the preferred form has been made only by way of example and that numerous changes in the details of construction and the combination and arrangement of parts may be resorted to without departing from the spirit and scope of the invention.

What is claimed is:

1. An artificial decorative plant having multiple leaves assembled and then attached to a main stem, wherein each leaf comprises:

a rod with a hook extended to engage the main stem;

at least one securing piece, with each securing piece having two longitudinal sides and multiple clamping pieces respectively formed on the two longitudinal sides with multiple intervals to wrap the rod;

multiple clamping attachments extended from the two longitudinal sides, with each clamping attachment being between adjacent two of the multiple clamping pieces; and at least one branch strip combined with a corresponding one of the multiple clamping attachments.

2. The artificial decorative plant as claimed in claim 1, wherein the multiple clamping attachments are oblique to the two longitudinal sides with each clamping attachment forming a sharp angle between itself and the at least one securing piece.

3. The artificial decorative plant as claimed in claim 1, wherein the at least one branch strip has multiple leaves.

4. The artificial decorative plant as claimed in claim 1, wherein the multiple leaves are made of PE or PVC.

5. The artificial decorative plant as claimed in claim 1, wherein the at least one branch strip is made of metal wire material.

6. The artificial decorative plant as claimed in claim 1, wherein the rod is made of resilient metal material.

* * * * *